US005163346A

United States Patent [19]

Zenner

[11] Patent Number: 5,163,346

[45] Date of Patent: Nov. 17, 1992

[54] ANTI-FREEZE BOTTLE OPENER

[76] Inventor: Joshua L. Zenner, R5979 Pioneer Rd., Athens, Wis. 54411

[21] Appl. No.: 757,191

[22] Filed: Sep. 10, 1991

[51] Int. Cl.[5] ..... B67B 7/00

[52] U.S. Cl. ..... 81/3.09; 81/3.47; 81/3.55; 81/3.57; 81/3.48

[58] Field of Search ..... 81/3.08, 3.09, 3.27, 81/3.55, 3.47, 3.57, 3.48, 3.49

[56] References Cited

U.S. PATENT DOCUMENTS

| | | | |
|---|---|---|---|
| 1,894,487 | 1/1933 | Gunther | 81/3.55 |
| 2,621,550 | 12/1952 | Bech | 81/3.57 |
| 3,037,279 | 6/1962 | Flemiy . | |
| 4,586,404 | 5/1986 | Ginther | 81/3.57 |

*Primary Examiner*—D. S. Meislin
*Attorney, Agent, or Firm*—Richard C. Litman

[57] ABSTRACT

A bottle cap and seal remover for removing the bottle cap and seal from a bottle of gas line anti-freeze, enabling the contents of the bottle to be poured into a gas tank. A first embodiment is formed as a hand-held opener which may be mounted on a key-ring so as to be readily available at the filling station. The first embodiment includes a handle and a plurality of lever portions integral with each other so as to provide structure to pry the bottle cap and seal from the top of the bottle. The second embodiment includes a board designed to be placed in filling station lanes so as to be accessible to both filling station customers and personnel, the board having a bottle cap remover, a seal piercer and remover, and a bottle cap and seal receptacle integrally mounted thereon to receive and retain the removed bottle caps and seals. Both the first and second embodiments may selectively have instructions and advertising on at least one surface.

2 Claims, 2 Drawing Sheets

ANTI-FREEZE BOTTLE OPENER

BACKGROUND OF THE INVENTION

1. Field of the Invention

This invention relates to a combination tool for opening anti-freeze bottles. The tool is intended to be used to open bottles or containers of gas line anti-freeze. Normally these bottles have a small cap which needs to be pried off, and a seal which needs to be broken before the anti-freeze is poured into the automobile gas tanks. The first embodiment involves a small hand-held opener mounted on a key-ring and which includes a first member and a second member connected to a handle for performing the prying and piercing function. The second embodiment includes a first member for removing the cap and a second member for puncturing and removing the seal under the cap, both members mounted on a flat plate or board, together with a container for collecting removed caps and seals.

2. Description of Prior Art

Bottle openers are of course known in the prior art. U.S. Design Patent No. Des. 126,577 issued Apr. 15, 1941 to Herman Erxleben discloses a receptacle opener having two different structural arrangements located at one end of the opener, one for prying a cap off a bottle, and the second for cutting through a top of a tin or metal can, the other end of the opener including an adjustable chain loop and what appears to be a series of saw teeth. There is no disclosure therein of using any of the disclosed components for piercing and prying off a seal at the top of a container.

U.S. Pat. No. 706,911 issued Aug. 12, 1902 to William L. Dunham, discloses a tool for removing caps from bottles, the tool being mountable on a key-ring. The disclosed configuration of the tool inherently prevents using the tool to also pry off a seal located under the cap, and there is no disclosure or suggestion of such a use by Dunham.

U.S Pat. No. 900,480 issued Oct. 6, 1908 to August A. Busch discloses a wall mounted bottle opener for removing bottle caps. There is no disclosure of structure capable of piercing a seal that may be located under the bottle cap.

U.S. Pat. No. 1,040,564 issued Oct. 8, 1912 to Arthur H. Merrill discloses a compound tool which may be used as either a wrench or a bottle cap remover, again with no disclosure of structure that would be effective to puncture and remove a seal disposed under the bottle cap.

U.S. Pat. No. 1,684,285 issued Sep. 11, 1928 to John H. McDonald discloses a wall mounted bottle cap remover coupled with a receptacle for collecting the removed caps. No structure is disclosed which could be used to pierce and remove a seal from the bottle.

U.S. Pat. No. 1.934,594 issued Nov. 7, 1933 to Henry J. Edlund discloses a container opener which may be used to either remove a bottle cap or to pry off a lid from a can. There is no disclosure of structure which could be used to pierce and remove a seal located under the bottle cap.

U.S. Pat. No. 2,106,639 issued Jan. 25, 1938 to George B. Jenkinson discloses a cap remover for containers and the like comprising two cooperating elements which selectively may be used in two different ways to remove a cap, neither of which is disclosed to be effective to remove seals located under the cap.

U.S. Pat. No. 2,118,159 issued May 24, 1938 to William H. Castner discloses a combination can punch and cap lifter which requires a complex configuration in order to achieve the function of removing a bottle cap or puncturing a hole in the top of a can. Further, while a can top is pierced, there is no disclosure in Castner of removing a seal.

U.S. Pat. No. 2,454,531 issued Nov. 23, 1948 to Ralph Van Trine, and U.S. Pat. No. 2,461,040 issued Feb. 8, 1949 to Armand Di Geronimo, disclose wall mounted bottle cap removers without seal piercing and removal. Van Trine also discloses a wall mounted receptacle for removed bottle caps.

U.S. Pat. No. 4,463,631 issued Aug. 7, 1984 to James E. Barnes et al. discloses a multipurpose opener having structure to remove bottle caps and to open so-called pop-tops. There is no disclosure by Barnes et al. of any structure designed to pierce and remove a seal located below the bottle caps.

SUMMARY AND OBJECTS OF THE INVENTION

It is an object of this invention to provide a simplified bottle opener and seal remover of use on anti-freeze bottles and the like.

It is another object of this invention to provide a simplified bottle opener and seal remover which may be placed on a key-ring.

It is still a further object of this invention to mount the bottle opener and seal remover on a board together with a container for receiving removed caps and seals.

The foregoing and other objects are achieved in a first embodiment by forming a hand-held opener from a blank configured in a manner similar to that shown in FIGS. 1, 2 and 3, with a single partially cut out portion serving to both pry off the cap and to pierce and remove the underlying seal. An upper portion can be used to both help in the removal of the bottle cap, and serve as a guide during piercing and removal of the seal.

In a second embodiment, a bottle cap remover and a seal piercing device are mounted on a board which is conveniently placed in filling station lanes. The board also mounts a container for storing the removed bottle caps and seals.

Other objects, features and advantages of this invention will become apparent from the following detailed description and the appended Claims, reference being had to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description and not limitation.

Figure 2:
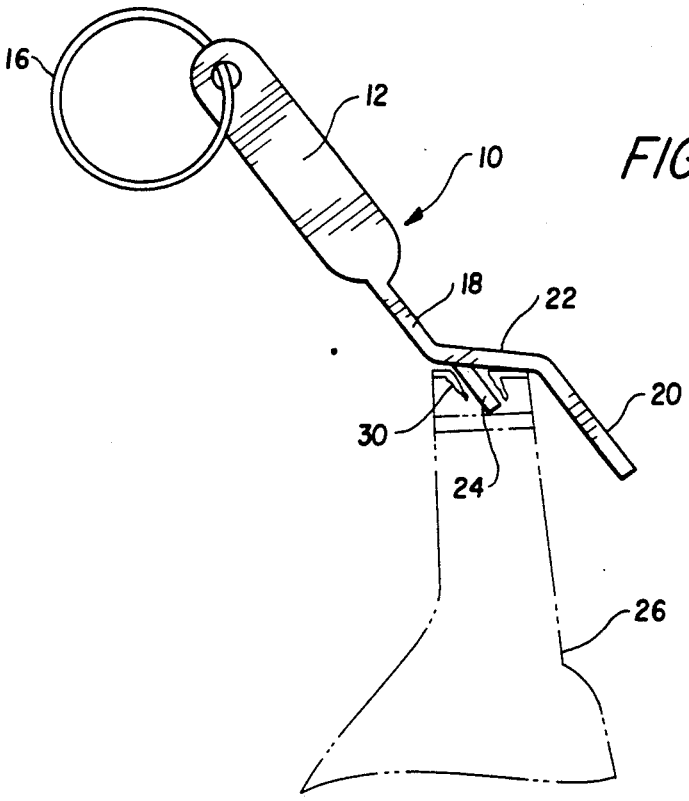
FIG. 2 is a side view of the bottle cap and seal remover in operative cooperation with a seal after removal of the bottle cap.
Figure 3:
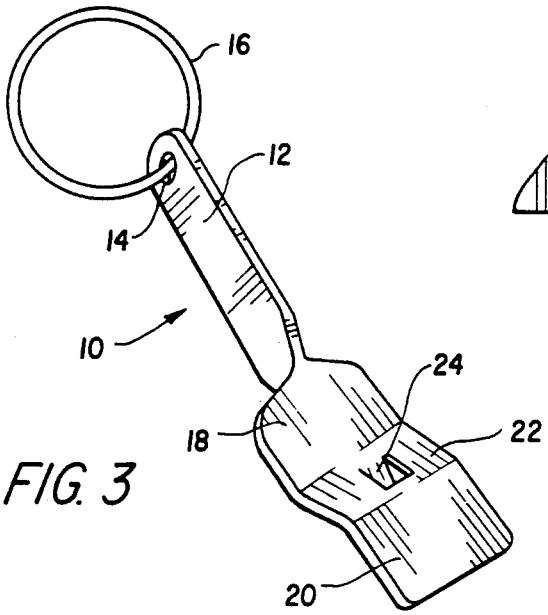
FIG. 3 is perspective view of the bottle cap and seal remover.
Figure 1:
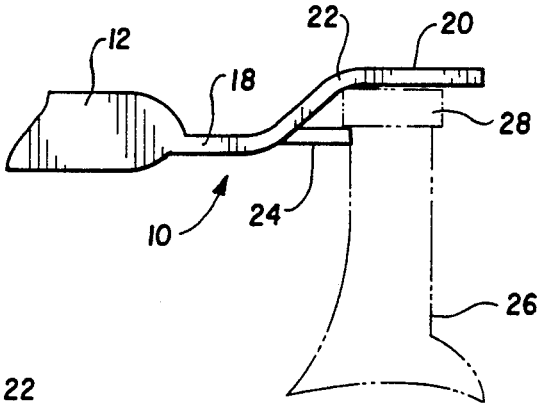
FIG. 1 is a side view of a bottle cap and seal remover in operative cooperation with a bottle cap.

The first embodiment of the invention, shown in FIGS. 1, 2 and 3, comprises a bottle cap and seal remover 10 formed from a metal blank and sized to be hand-held. As shown in FIG. 3, bottle cap and seal remover 10 includes a handle portion 12 having a hole 14 for mounting a key-ring 16. Integral with handle portion 12 but rotated 90 degrees is a first planar lever portion 18 extending in a plane parallel a longitudinal axis of the handle portion, a second planar lever portion 20 extending in a plane parallel to but raised above said first planar lever portion 18, and an intermediate lever portion 22 integral with aid first and second planar lever portions and disposed at a 45 degree angle relative the planes of said first and second planar lever portions 18 and 20. Extending from intermediate lever portion 22 is a short lever portion 24 which lies in a plane parallel to the planes of first planar lever portion 18 and second planer lever portion 20. Short lever portion 24 is formed as a partial cutout of intermediate lever portion 22.

Bottle cap and seal remover 10 is specifically designed for the removal of bottle caps 28 and seals 30 found on bottles 26 containing anti-freeze intended as an additive to gas tanks and gas lines. In FIG. 1, bottle cap and seal remover is positioned to remove bottle cap 28 from bottle 26. Second planar lever portion 20 is placed over the top surface of bottle cap 28, while the end of short lever portion 24 is spaced so as to engage the bottom surface of cap 28. By lifting up on handle portion 12, cap 28 is then pried off of bottle 26.

Normally, in bottles of anti-freeze intended for use an additive to automobile gas tanks and gas lines, there is a seal 30 below cap 28. Seal 30 must be punctured and removed before the anti-freeze in bottle 26 can be poured into the gas tank. In FIG. 2, bottle cap and seal remover 10 is positioned subsequent to the puncturing but prior to the removal of the seal 30. Normally such seals, after being punctured by a screw driver, can be removed by prying the seal out of the opening at the top of bottle 28. In FIG. 2, short lever portion 24 is shown as having pierced seal 30, using second planar lever portion 20 and intermediate lever portion 22 as a guide. Bottle cap and seal remover 10 can then be tilted to remove seal 30 from bottle 26.

Figure 4:
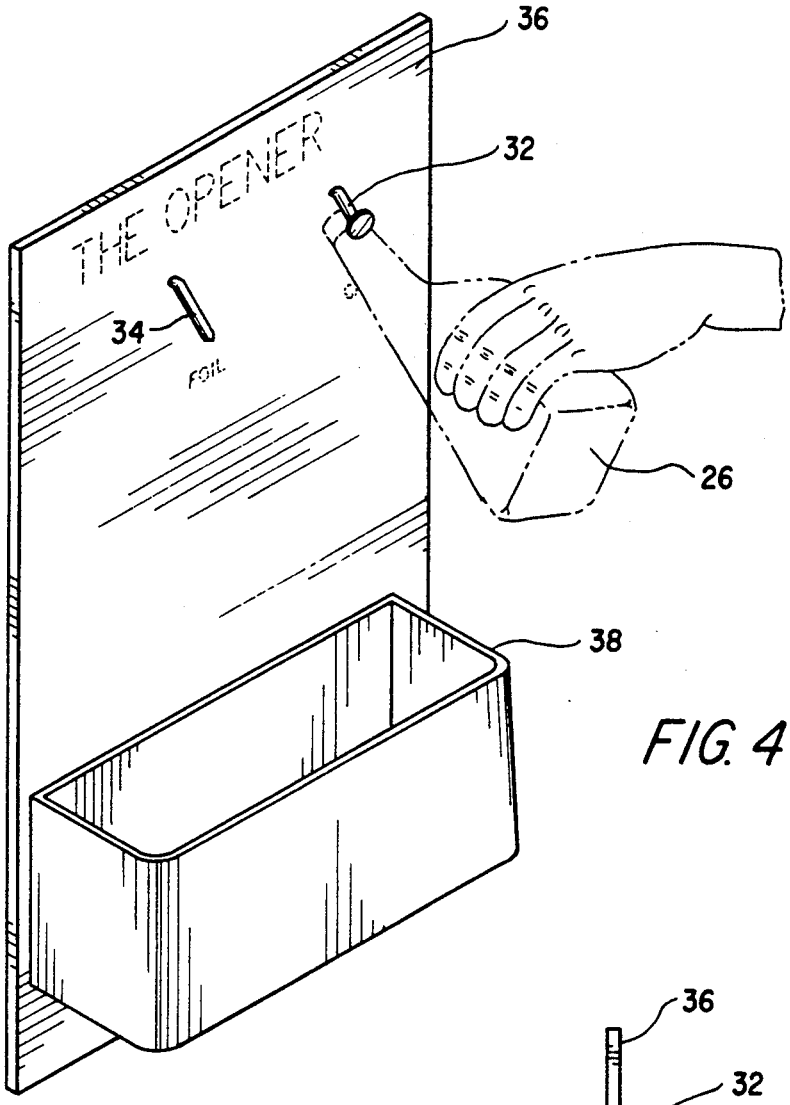
FIG. 4 is a perspective view of a second embodiment of the bottle cap and seal removal.
Figure 5:
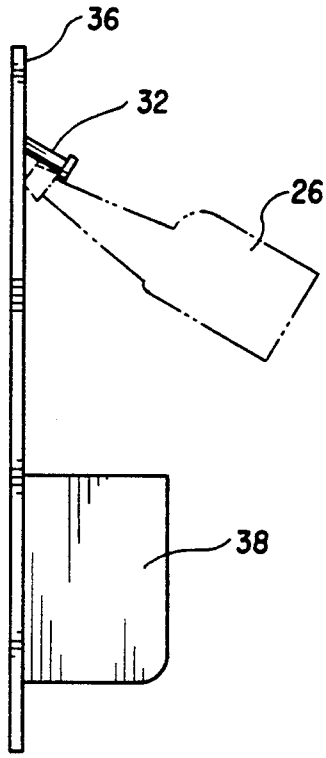
FIG. 5 is a side view of the embodiment of FIG. 4.

FIGS. 4 and 5 show a second embodiment designed to be placed at filling station lanes for the convenience of customers who intend to add anti-freeze to their gas tanks. In the second embodiment a bottle cap remover 32 and a device 34 to pierce and remove seals 30 are mounted on a board 36, which also supports a receptacle 38 to catch and retain the removed bottle caps 28 and seals 30. As shown, the customer or gas station attendant would first pry off the bottle cap 28 and then pierce and remove the seal 30 from a bottle 26 in much the same way as done with the first embodiment, before pouring the anti-freeze into the gas tank.

Board 36 can have instructions and/or advertising printed thereon, and can be permanently located in the filling station lanes. This invention can be used in all states whose temperatures reach near or below the freezing mark. The design is such that it eases the opening of gas-line anti-freeze bottles.

While it will be apparent that the preferred embodiment of the invention herein disclosed is well calculated to fulfill the objects above-stated, it will be appreciated that the invention is susceptible to modification and change without departing from the proper scope or fair meaning of the subjoined claims.

I claim:

1. A bottle cap and seal remover for removing bottle caps and seals from gas line anti-freeze bottles, comprising:

supporting means, including a handle having an opening at one end to receive a key ring, said handle being integral with said bottle cap and seal removing means at an end opposite said one end, said handle and said bottle cap and seal removing means being formed from a metal blank, said handle being oriented in a plane perpendicular to a plane containing at least one of said bottle cap and seal removing means, whereby a user may conveniently carry said bottle cap and seal remover on a key ring with automobile keys; and bottle cap and seal removing means integral with and supported by said supporting means, whereby a bottle cap and a seal for sealing a gas line anti-freeze bottle located beneath the bottle cap may be sequentially removed from the anti-freeze bottle, thereby enabling contents of the anti-freeze bottle to be poured into a gas tank, said bottle cap and seal removing means including a first planar lever portion integral with said handle, said first planar lever portion being located in a plane perpendicular to the plane of said handle, a second planer lever portion located in a plane disposed above and parallel to the plane of said first lever portion, an intermediate lever portion integral with said first planar lever portion and said second planar lever portion and located in a plane disposed at a 45 degree angle relative to the planes of said first and second lever portions, and a short lever portion extending from said intermediate lever portion in a plane parallel to the planes of said first and second planar lever portions and formed as a partial cut-out in said intermediate lever portion, whereby said second planar lever portion cooperates with said short lever portion to pry the cap from the anti-freeze bottle, and said second planar lever portion acts as a guide when said short lever portion is used to pierce the seal and cooperates with said short lever portion to remove the seal from the anti-freeze bottle.

2. A bottle cap and seal remover as in claim 1, said supporting means selectively including instructions and advertising on at least one surface thereof.

* * * * *